US006554214B2

(12) United States Patent
Vomhof et al.

(10) Patent No.: US 6,554,214 B2
(45) Date of Patent: Apr. 29, 2003

(54) GRINDER USED IN MEAT GRINDING

(75) Inventors: Paul Vomhof, Bad Laasphe (DE); Willi Eschenroder, Biedenkopf-Wallau (DE)

(73) Assignee: Convenience Food Systems Wallau GmbH & Co. KG, Biedenkopf-Wallau (DE)

( * ) Notice: Subject to any disclaimer, the term of this patent is extended or adjusted under 35 U.S.C. 154(b) by 0 days.

(21) Appl. No.: 09/803,230

(22) Filed: Mar. 9, 2001

(65) Prior Publication Data

US 2001/0020655 A1 Sep. 13, 2001

(30) Foreign Application Priority Data

Mar. 10, 2000 (DE) ..... 10011135

(51) Int. Cl.[7] ..... B02C 18/30

(52) U.S. Cl. ..... 241/82.5

(58) Field of Search ..... 241/82.7

(56) References Cited

FOREIGN PATENT DOCUMENTS

| | | |
|---|---|---|
| DE | 29809485 | 10/1998 |
| DE | 29911090 U1 | 11/1999 |
| WO | WO 97/05953 | 2/1997 |

*Primary Examiner*—Mark Rosenbaum
(74) *Attorney, Agent, or Firm*—Perman & Green, LLP

(57) ABSTRACT

The present invention relates to a grinder having a worm conveyor and a set of blades consisting of a first carving blade arranged after the worm conveyor, an additional, second carving blade arranged after the first carving blade, a perforated disc arranged at a fixed distance after the second carving blade, and a driven blade arranged between the second carving blade and the perforated disc, the set of blades being clamped with a cap nut in the worm housing.

11 Claims, 9 Drawing Sheets

GRINDER USED IN MEAT GRINDING

The present invention relates to a grinder having a worm conveyor and a set of blades consisting of a first carving blade arranged after the worm conveyor, an additional, second carving blade arranged after the first carving blade, a perforated disc arranged at a fixed distance after the second carving blade, and a driven blade arranged between the second carving blade and the perforated disc, the set of blades being clamped with a cap nut in the worm housing.

Such grinders used in meat grinding are well-known from prior art. It is particularly important in such grinders that the play between the blade and the perforated disc on the one hand, and between the blade and the second carving blade on the other hand be as low as possible in order to achieve optimum cutting results. In the past, these spacings steadily increased as a result of blade wear during the cutting process, so that the cutting results grew worse over time. Furthermore, depending on whether fresh meat or frozen meat is to be processed, the sets of blades have to be replaced in prior art grinders.

It was therefore the object to provide a grinder that would not involve the drawbacks of the prior art.

Said object is accomplished by using a grinder in accordance with claim 1, wherein

- the distance between the first carving blade and the perforated disc is greater than or equal to the axial extension of the blade and the second carving blade,
- the blade on the drive shaft and the second carving blade in the housing rest on bearings in an axially displaceable fashion, and
- the blade is pressed against the perforated disc by a first pressure element, and the second carving blade is pressed against the blade by a second pressure element.

According to the invention, the blade is pressed with spring-loading against the perforated disc by a pressure element. In addition, the second carving blade is pressed with spring-loading against the blade by another pressure element.

Preferably, the pressure elements are helical springs, and the contact pressure applied to each constructional element preferably is variable. The contact pressure used to press the blade against the perforated disc preferably is greater than the contact pressure used to press the second carving blade against the blade.

The present invention is also directed to a grinder having a worm conveyor and a set of blades consisting of a first carving blade arranged after the worm conveyor, a second carving blade arranged after the first carving blade, a perforated disc arranged at a fixed distance after the first carving blade, and a driven blade arranged between the second carving blade and the perforated disc, the set of blades being clamped with a cap nut in the worm housing, the distance between the first carving blade and the perforated disc being greater than or equal to the axial extension of the blade and second carving blade, the blade on the drive shaft and the second carving blade in the housing resting on bearings in an axially displaceable fashion, and a pressure element pressing the second carving blade with spring-loading against the blade and the blade with spring-loading against the perforated disc.

The pressure element preferably is a helical spring.

Advantageous embodiments of the grinder according to the invention will be described in the subclaims.

Even with advancing wear, the grinder of the invention ensures a constant distance between the perforated disc and the blade and between the blade and the second carving blade. Furthermore, it is possible to process both fresh and frozen meat with the same set of blades without retooling, because the cutting tools are guided with precision as a result of the constant preset cutting pressure. The cutting pressure results from the characteristic curve of the pressure elements and the properties of the product to be processed. Also, increased wear of the set of blades by excessive clamping of the set of blades by the cap nut is eliminated.

The grinder of the invention is particularly suitable in the grinding of fresh and/or frozen meat.

With reference to the FIGS. 1-9, the invention will be illustrated below. These illustration are merely by way of example and do not limit the general idea of the invention.

Figure 1:
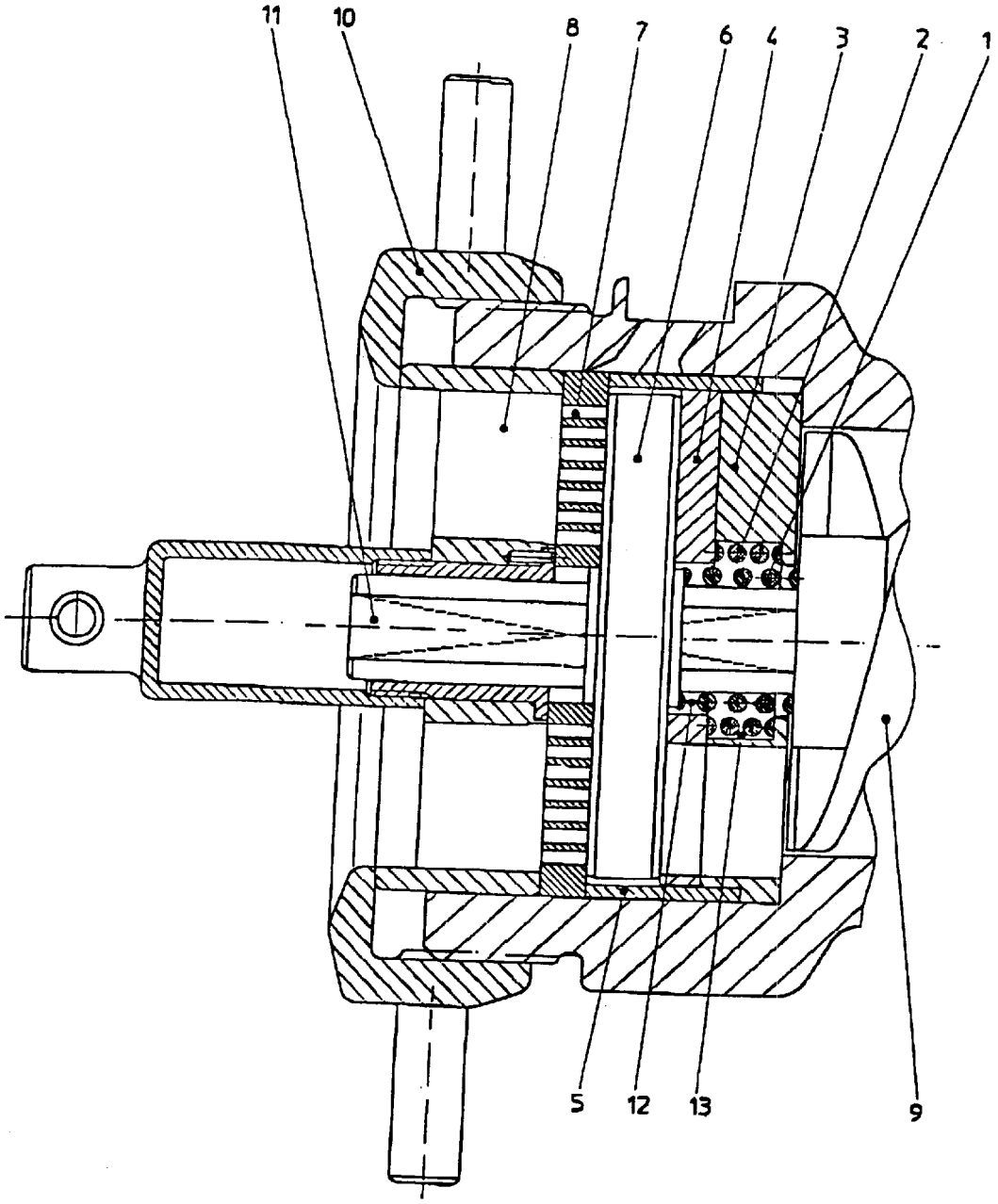
FIG. 1 shows an assembly drawing of the grinder according to the invention including two pressure elements.

FIG. 1 shows an assembly drawing of the grinder according to the invention. The grinder has a partially depicted worm conveyor 9 which is used to convey the non-ground meat to the set of blades of the grinder. The set of blades consists of a first carving blade 3, a second carving blade 4, a blade 6, and a perforated disc 7. The first carving blade 3 is arranged directly after the worm conveyor 9. After the first carving blade 3, the perforated disc 7 is arranged at a fixed distance. In the present example, the fixed distance between the first carving blade 3 and the perforated disc 7 is accomplished by means of spacer 5. The second carving blade 4 and blade 6 are arranged between the first carving blade 3 and the perforated disc 7. The second carving blade 4 rests on a bearing in the housing in a displaceable fashion. In the present case, the spacer 5 simultaneously represents the guidance for the second carving blade 4. The blade 6 is arranged after the second carving blade 4. The distance between the first carving blade 3 and the perforated disc 7 is greater than or equal to the axial extension of the blade 6 and the second carving blade 4. Blade 6 rests on a bearing on drive shaft 11 in a displaceable, yet non-rotatable fashion. The set of blades is clamped in the worm housing of the grinder by means of cap nut 10 via support cross 8. The distance between the perforated disc 7 and the first carving blade 3 is independent of the degree by which cap nut 10 is tightened.

The inner diameter of the second carving blade 4 is greater than the diameter of drive shaft 11, resulting in a first annular gap 12 between carving blade 4 and drive shaft 11. The inner diameter of the first carving blade 3 partially is greater than the inner diameter of carving blade 4, thus forming a second annular gap 13 between the first carving blade 3 and drive shaft 11. These annular gaps 12, 13 have arranged therein the helical springs 1 and 2, with helical spring 1 taking effect between blade 6 and worm conveyor 9, and helical spring 2 between the first carving blade 3 and the second carving blade 4. Such an arrangement is advantageous in that the helical springs are not located within the direct flow of product. Because the grinder has two springs, the contact pressure pressing blade 6 against perforated disc 7 and the contact pressure pressing the carving blade 4 against blade 6 can be adjusted differently each time. Conveniently, the contact pressure pressing blade 6 against perforated disc 7 is higher than the contact pressure pressing the carving blade 4 against blade 6. With increasing wear, blade 6 and carving blade 4 are steadily re-adjusted automatically, so that the cutting results will remain constant over a long period of time.

Figure 2:
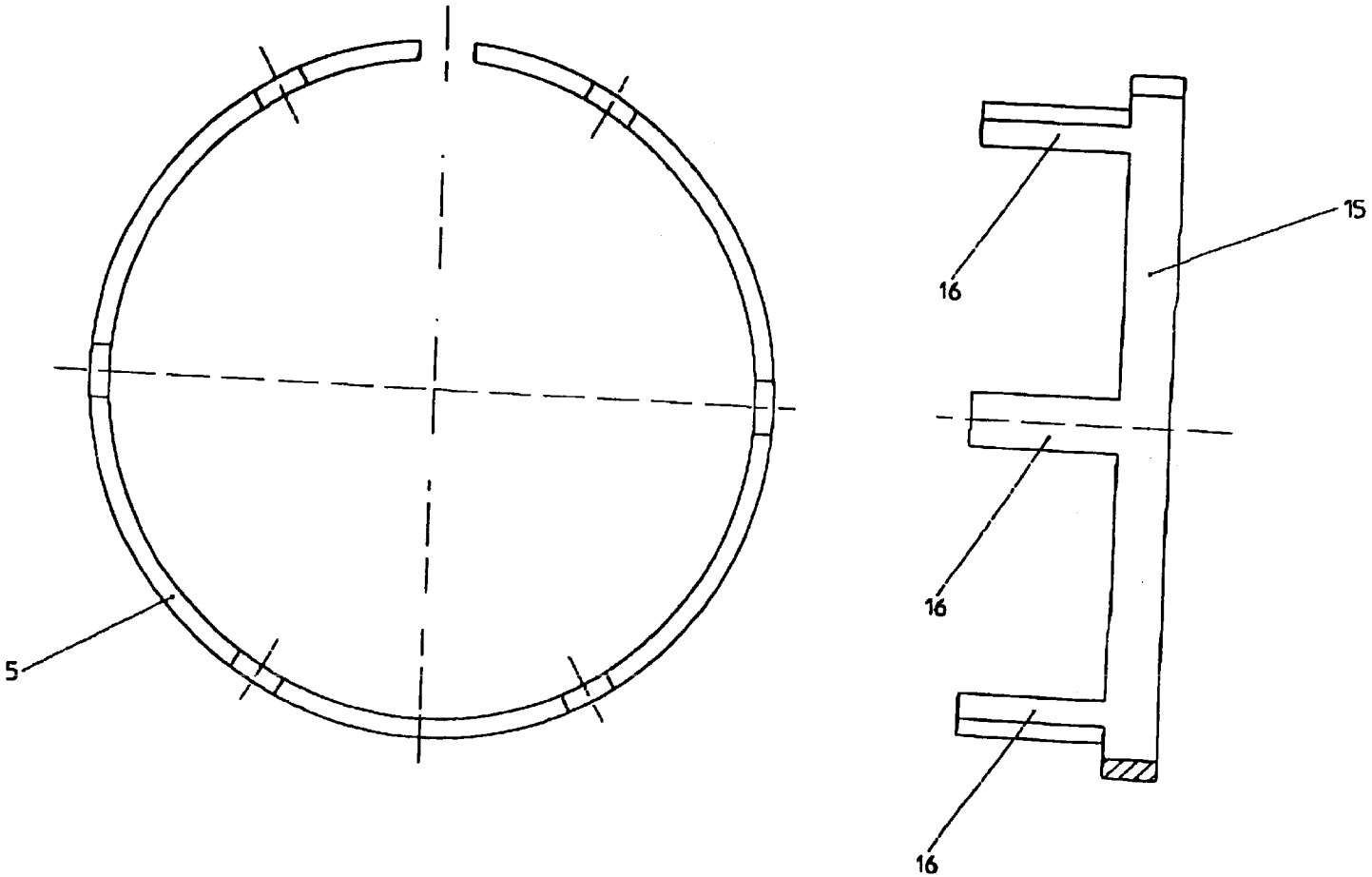
FIG. 2 shows an embodiment of the spacer.

FIG. 2 illustrates an embodiment of spacer 5 which, however, is not installed in the grinder according to FIG. 1. Spacer 5 is arranged between the first carving blade 3 and the perforated disc 7. The spacer 5 is comprised of a ring 15 and six ribs 16. Ring 15 rests in a bearing in a recess in first carving blade 3, while perforated disc 7 is supported on the ribs 16. In addition, the ribs 16 serve as a guidance for the axial displacement of the second carving blade 4.

Figure 3:
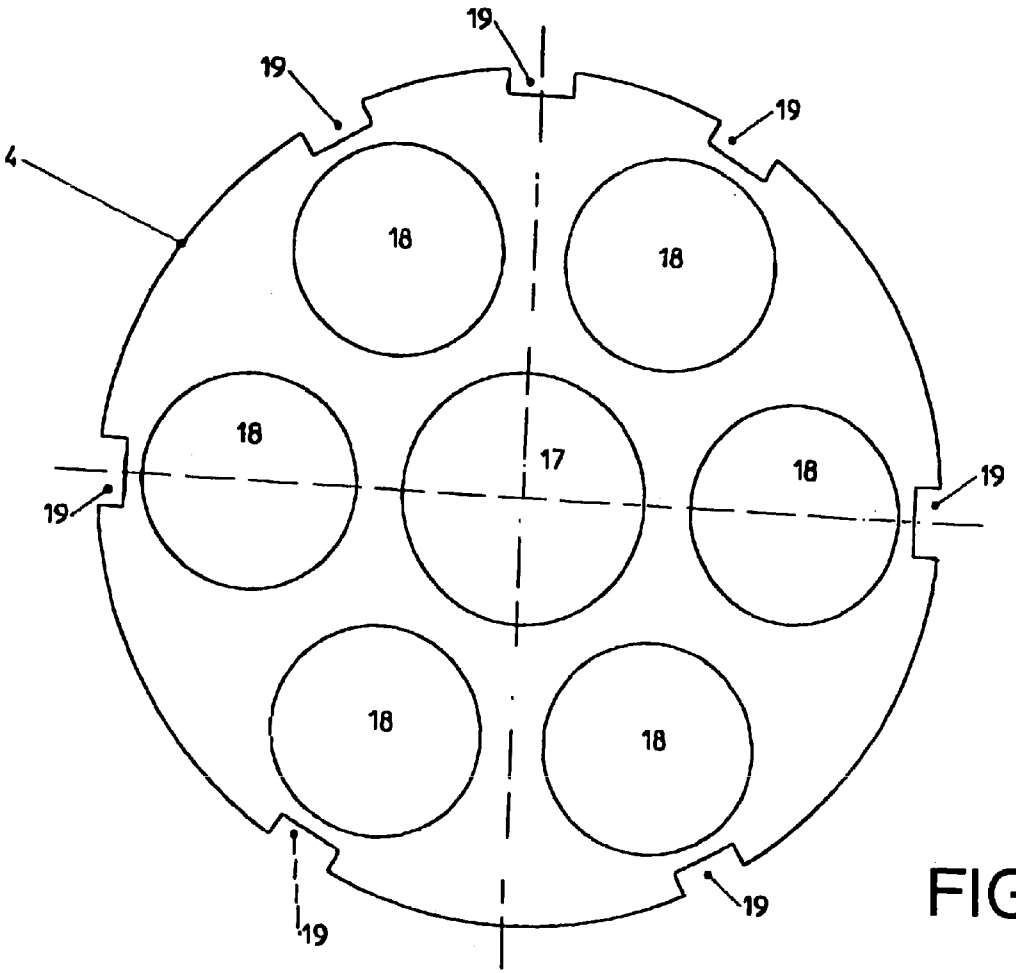
FIG. 3 illustrates an embodiment of the second carving blade.

FIG. 3 shows the carving blade 4. The bore 17 receives the drive shaft 11. The six bores 18 act to press the meat, thereby effecting initial cutting. Along its circumference, the carving blade 4 has six grooves 19 receiving the ribs 16 of spacer 5.

Figure 4:
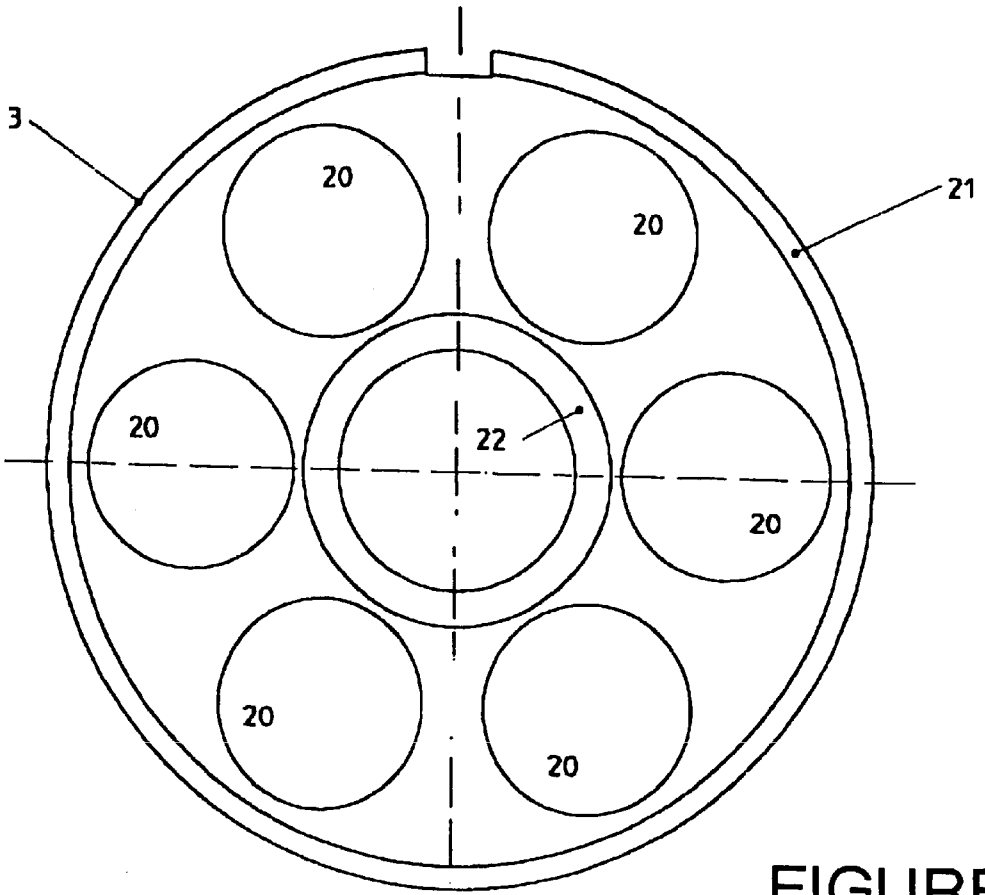
FIG. 4 illustrates an embodiment of the first carving blade.
Figure 4:
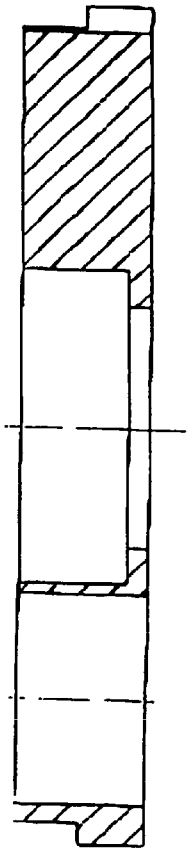

FIG. 4 shows the first carving blade 3. The bores 20 act to press the meat, thereby effecting initial cutting. The bores 20 are of the same diameter as bores 18, being in flush arrangement with same. Along its circumference, the carving blade 3 has a groove 21 receiving spacer 5. The annular ring 22 serves as a counterflange for helical spring 2.

Figure 5:
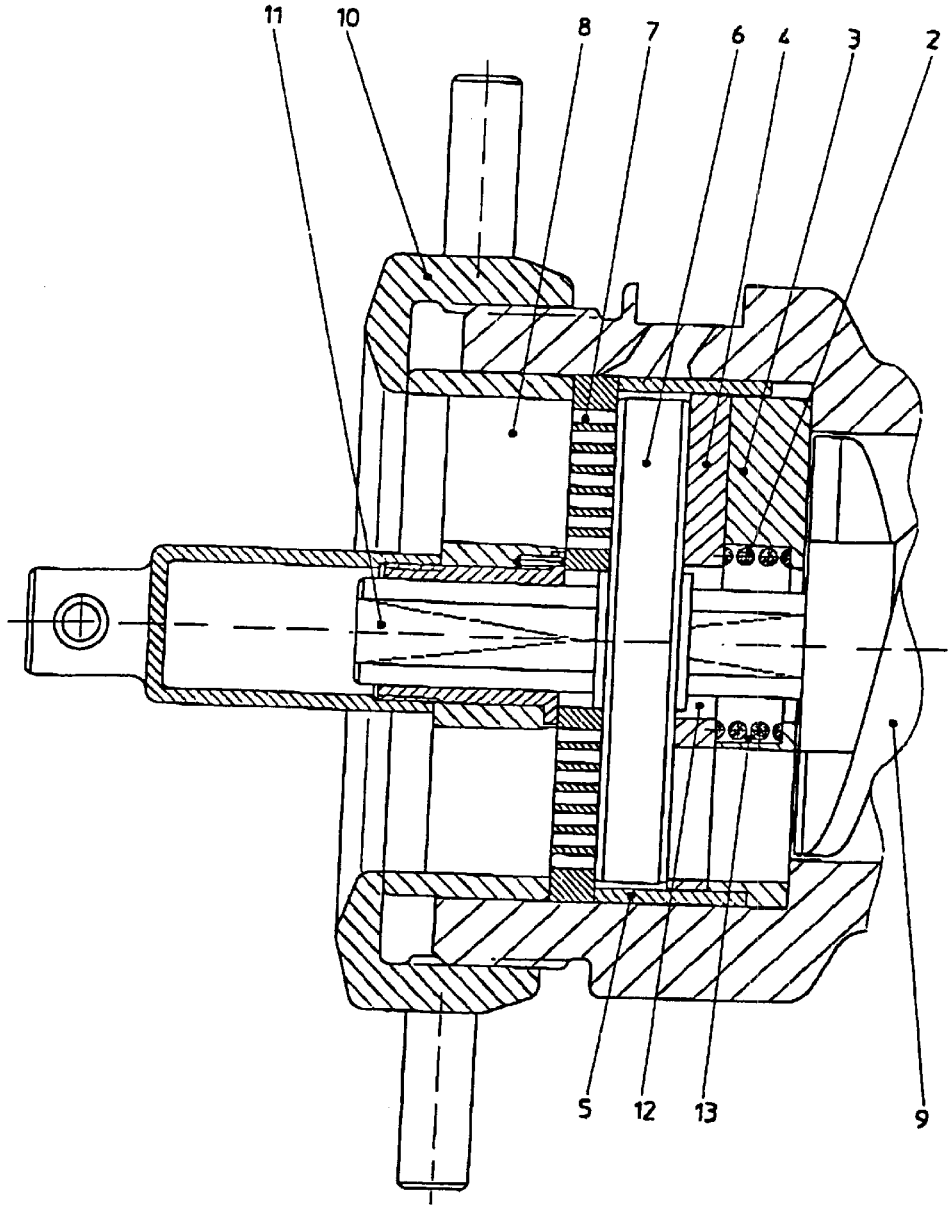
FIG. 5 shows an assembly drawing of the grinder according to the invention including one pressure element.

FIG. 5 illustrates another embodiment of the grinder according to the invention, which is different from the embodiment of the grinder in accordance with FIG. 1 in that it has one single helical spring 2 as pressure element. Said helical spring 2 presses the carving blade 4 against blade 6. Owing to the pressure of the helical spring, blade 6 in turn is pressed against perforated disc 7. Even in case of wearing of the set of blades, the above embodiment ensures a constant distance between the blade and the perforated disc on the one hand, and between the blade and the carving blade 4 on the other hand. This embodiment of the grinder according to the invention is particularly facile with respect to production, assembly and maintenance.

Figure 6:
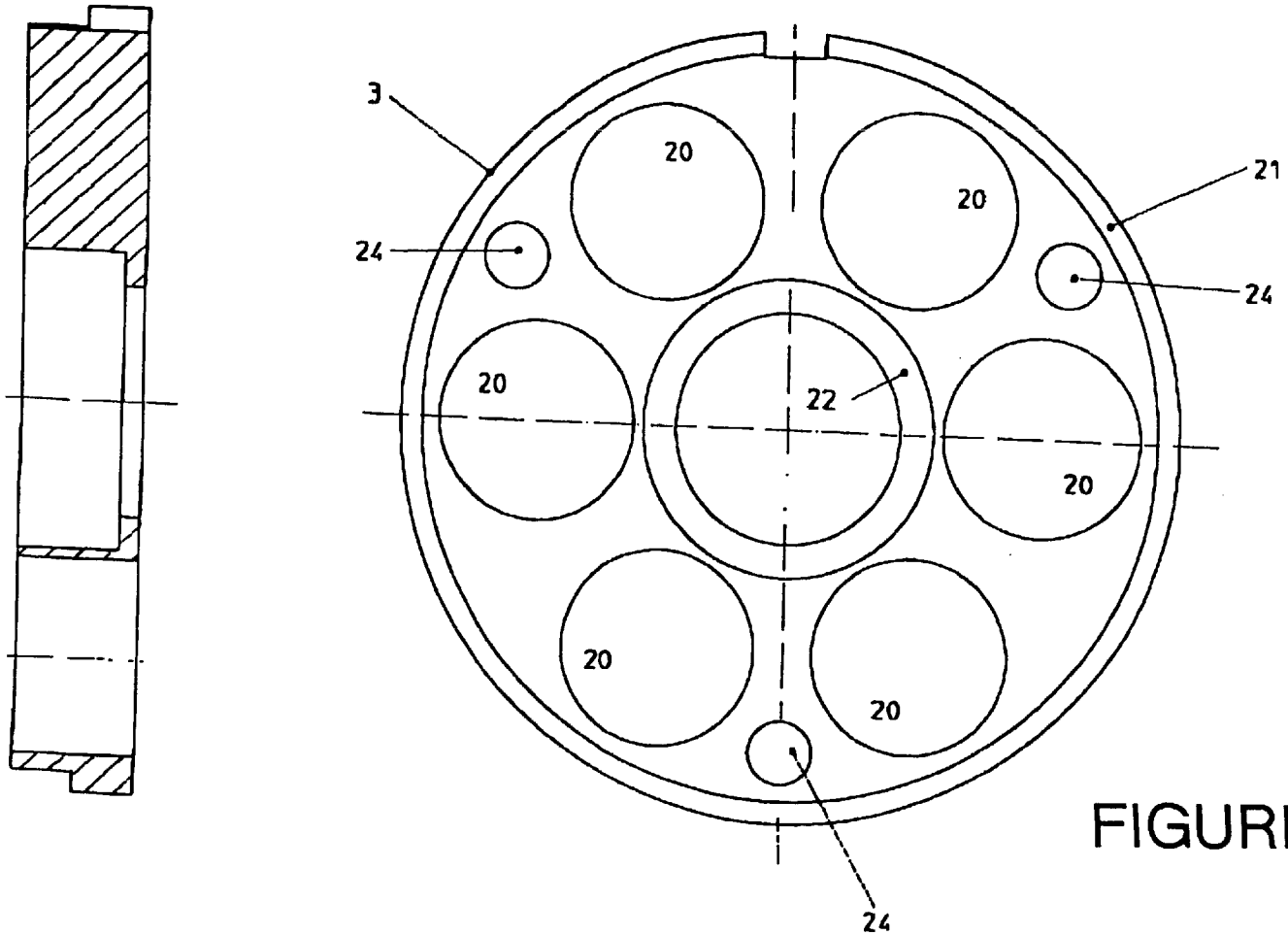
FIG. 6 illustrates another embodiment of the first carving blade.

FIG. 6 shows another embodiment of the first carving blade 3. In contrast to the first carving blade 3 according to FIG. 4, this carving blade has 3 bores 24. The bores 24 receive the bolts 25 (cf., FIG. 8) which are affixed to the second carving blade 4. The bores 24 serve as an axial guidance for bolts 25.

Figure 7:
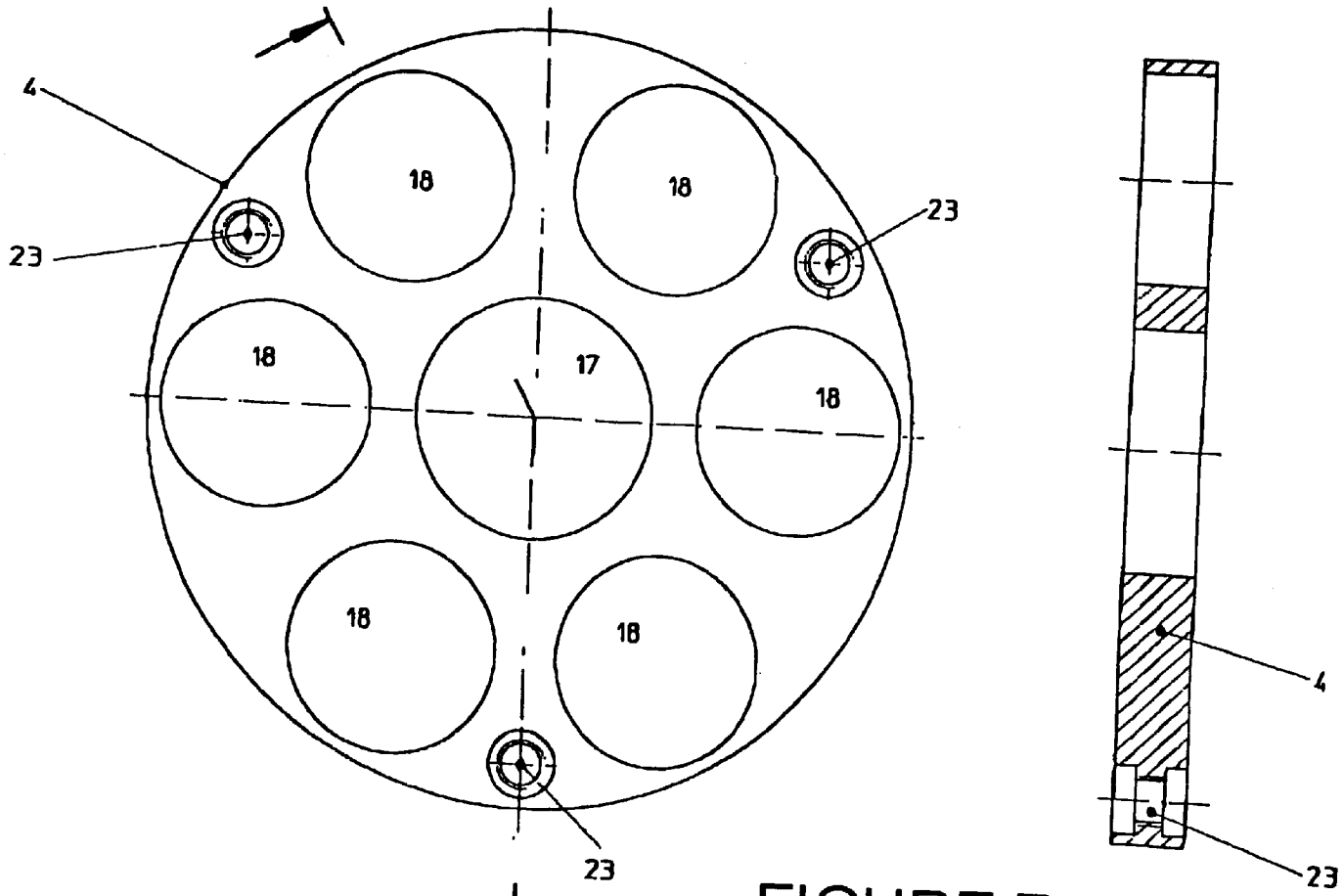
FIG. 7 illustrates another embodiment of the second carving blade.

FIG. 7 shows another embodiment of carving blade 4 which has bores 23. These bores are provided with a center thread, into which the bolts 25 can be screwed. Those skilled in the art will recognize that the bolts 25 can be screwed into the thread of bore 23 from both sides.

Figure 8:
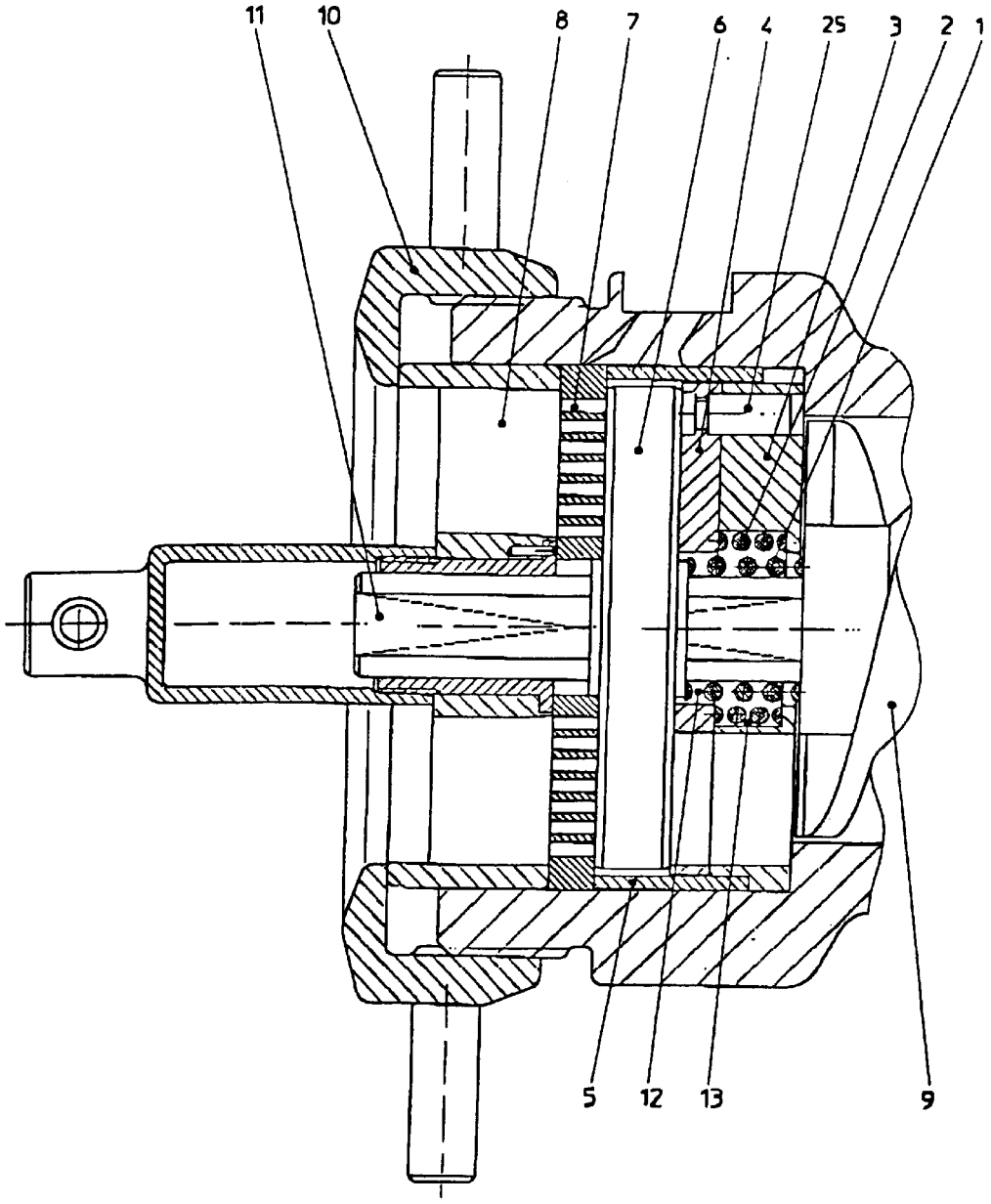
FIG. 8 shows an assembly drawing of the grinder according to the invention including two pressure elements and bolts as a guidance for the second carving blade.

FIG. 8 shows an assembly drawing of the grinder according to the invention which essentially is in accordance with the grinder of FIG. 1. The grinder according to FIG. 4 has bolts 25 screwed in bores 23 of the second carving blade 4. These bolts 25 are received by bores 24 in the first carving blade 3. The diameter of bores 24 is dimensioned such that the bolts 25 have only little play in bores 24, so that the bores 24 serve as an axial bearing for bolts 25 and thus, for the second carving blade 4.

Figure 9:
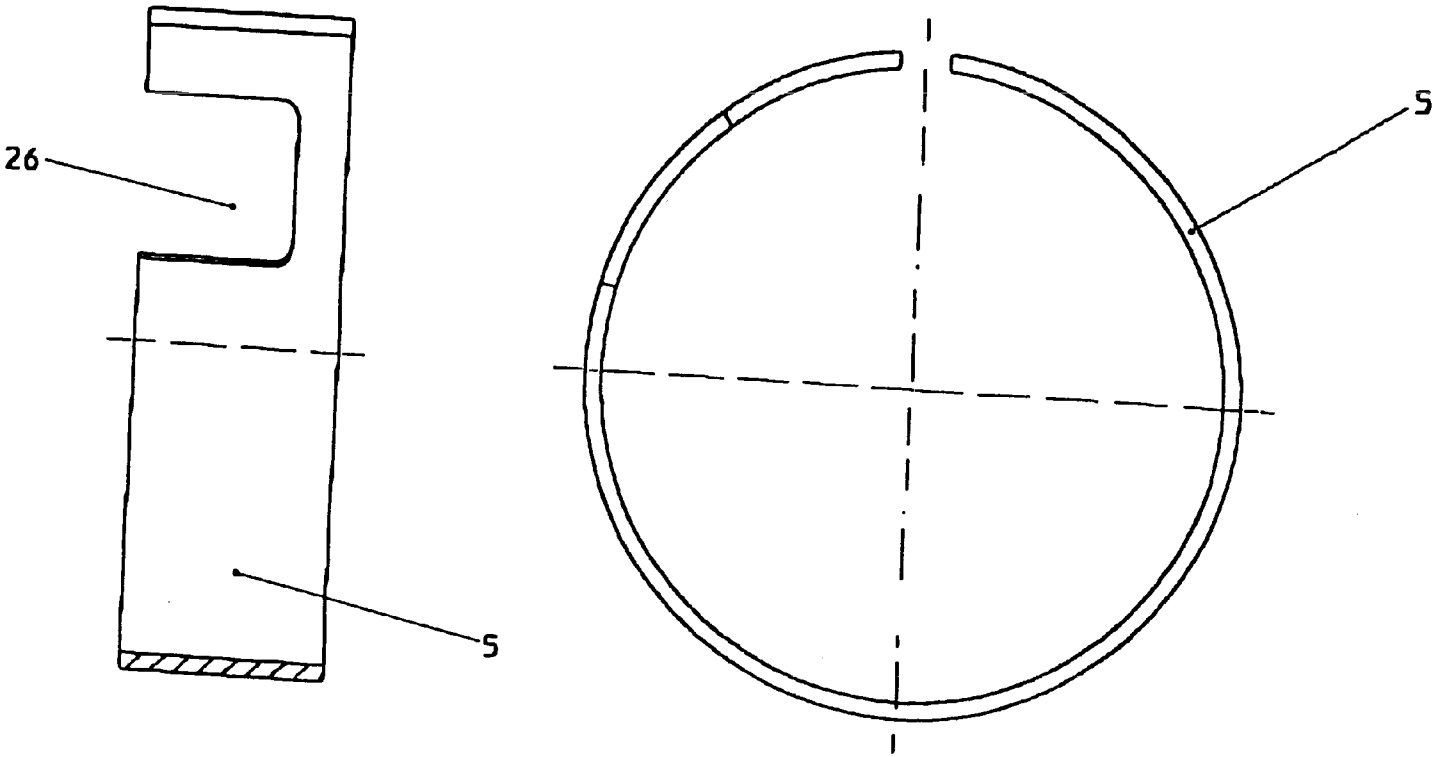
FIG. 9 illustrates another embodiment of the spacer.

FIG. 9 shows another embodiment of spacer 5. This spacer is in accordance with the spacers in FIGS. 1, 5, 8. The spacer 5 has an opening through which cartilages and the like can be separated from the meat mass. The spacer can be made of plastic or steel.

What is claimed is:

1. A grinder having a worm conveyor (9) and a set of blades consisting of a carving blade (3) arranged after the worm conveyor (9), an additional carving blade (4), having an axial extension, arranged after carving blade (3), a perforated disc (7) arranged at a fixed distance after carving blade (3), and a driven blade (6), having an axial extension, arranged between carving blade (4) and perforated disc (7), the set of blades being clamped with a cap nut (10) in the worm housing, characterized in that the distance between carving blade (3) and perforated disc (7) is greater than or equal to the axial extension of blade (6) and second carving blade (4), that blade (6) on drive shaft (11) and carving blade (4) in the housing rest on bearings in an axially displaceable fashion, that blade (6) is pressed against perforated disc (7) by a first pressure element (1), and that carving blade (4) is pressed against blade (6) by a second pressure element (2).

2. The grinder according to claim 1, characterized in that the carving blade (4) has a larger inner diameter compared to the diameter of drive shaft (11), that the carving blade (3) at least partially has a larger inner diameter compared to the inner diameter of carving blade (4), and that a first pressure element (1) acting on blade (6) is arranged in gap (12), and a second pressure element (2) acting on carving blade (4) is arranged in gap (13).

3. The grinder according to claim 1 characterized in that the pressing force of the first pressure element (1) is higher than the pressing force of the second pressure element (2).

4. The grinder according to claim 1 characterized in that the pressure elements (1, 2) are helical springs.

5. The grinder according to claim 1 characterized in that the grinder has a spacer (5) used to maintain the fixed distance between perforated disc (7) and carving blade (3).

6. The grinder according to claim 5, characterized in that the spacer (5) has a ring (15) and ribs (16).

7. The grinder according to claim 6, characterized in that the carving blade (4) rests on the ribs (16) of spacer (5) in a displaceable fashion.

8. The grinder according to claim 1 characterized in that the carving blade (4) has bolts (25) and the carving blade (3) has bores (24) receiving the bolts (25).

9. The grinder according to claim 1 characterized in that it is used for grinding fresh and/or frozen meat.

10. A grinder having a worm conveyor (9) and a set of blades consisting of a carving blade (3) arranged after the worm conveyer (9), an additional caving blade (4), having an axial extension, arranged after carving blade (3), a perforated disc (7) arranged at a fixed distance after carving blade (3), and a driven blade (6), having an axial extension, arranged between carving blade (4) and perforated disc (7), the set of blades being clamped with a cap nut (10) in the worm housing, characterized in that the distance between carving blade (3) and perforated disc (7) is greater than or equal to the axial extension of blade (6) and second carving blade (4), that blade (6) on drive shaft (11) and carving blade (4) in the housing rest on bearings in an axially displaceable fashion, and that a pressure element (2) presses the carving blade (4) against blade (6) and blade (6) against perforated disc (7).

11. The grinder according to claim 10, characterized in that the carving blade (3) at least partially has a larger inner diameter compared to the inner diameter of carving blade (4), and that the pressure element (2) is arranged in gap (13).

* * * * *